US005959393A

United States Patent [19]

Gors et al.

[11] Patent Number: 5,959,393

[45] Date of Patent: Sep. 28, 1999

[54] SURFACE MOUNT ASSEMBLY FOR INCANDESCENT LAMPS AND OTHER ELECTRICAL COMPONENTS

[75] Inventors: Neal Jones Gors, Petaluma; William Franklin Redmond, Santa Rosa, both of Calif.

[73] Assignee: Miyakawa Corporation, Tokyo, Japan

[21] Appl. No.: 08/825,721

[22] Filed: Apr. 2, 1997

[51] Int. Cl.[6] ..... H01J 5/48

[52] U.S. Cl. ..... 313/318.02; 313/318.01; 313/624

[58] Field of Search ..... 313/318.02, 318.01, 313/578, 580, 624, 625, 634

[56] References Cited

U.S. PATENT DOCUMENTS

| | | | |
|---|---|---|---|
| 2,134,472 | 10/1938 | Criger et al. | 176/32 |
| 2,541,941 | 2/1951 | Shenk | 240/10.6 |
| 3,448,321 | 6/1969 | Shanks | 313/315 |
| 4,017,758 | 4/1977 | Almer et al. | 313/112 |
| 4,918,355 | 4/1990 | Morris et al. | 313/318 |
| 4,952,838 | 8/1990 | DuNah | 313/318 |
| 4,970,428 | 11/1990 | Hayakawa et al. | 313/318 |
| 5,013,962 | 5/1991 | Desclos | 313/318 |
| 5,130,604 | 7/1992 | Franks, Jr. et al. | 313/580 |
| 5,138,226 | 8/1992 | Johnson | 313/623 |
| 5,382,874 | 1/1995 | Johnson | 313/578 |

*Primary Examiner*—Vip Patel

*Attorney, Agent, or Firm*—Flehr Hohbach Test Albritton & Herbert LLP

[57] ABSTRACT

A surface mount assembly. The assembly includes an elongated sealed envelope, such as an incandescent lamp with a filament positioned in the envelope, first and second leads extending from the spaced ends of the envelope and a metal material applied to the second leads. The leads and metal are configured to form a pair of electrically conductive mounting members at the ends of the envelope for mounting the envelope to a circuit board.

10 Claims, 2 Drawing Sheets

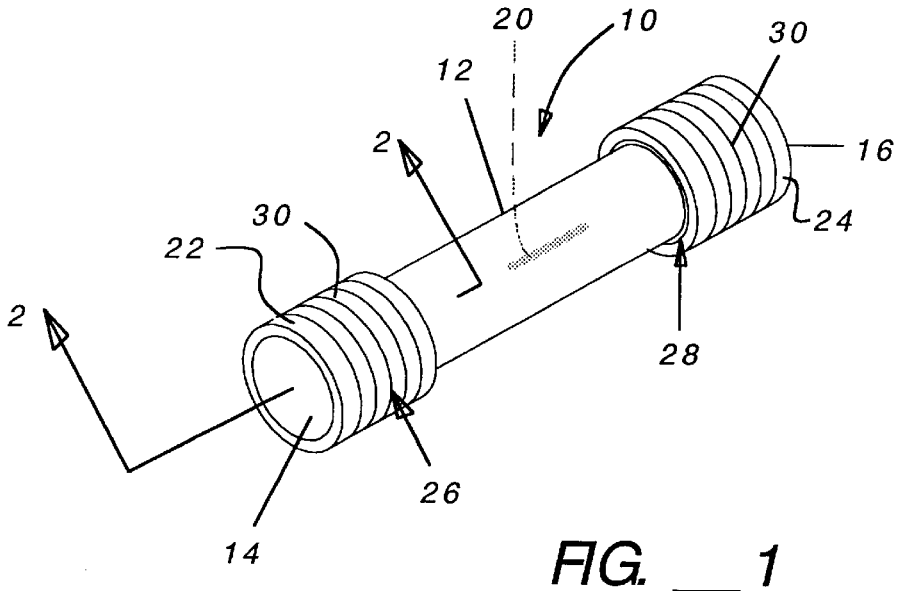
FIG. __1
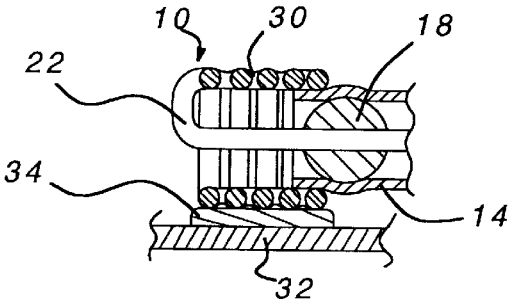
FIG.__2
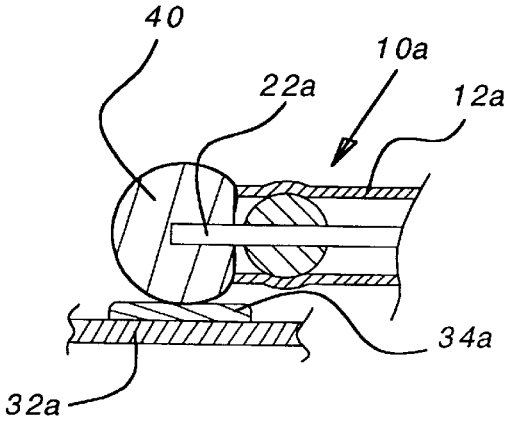
FIG.__4

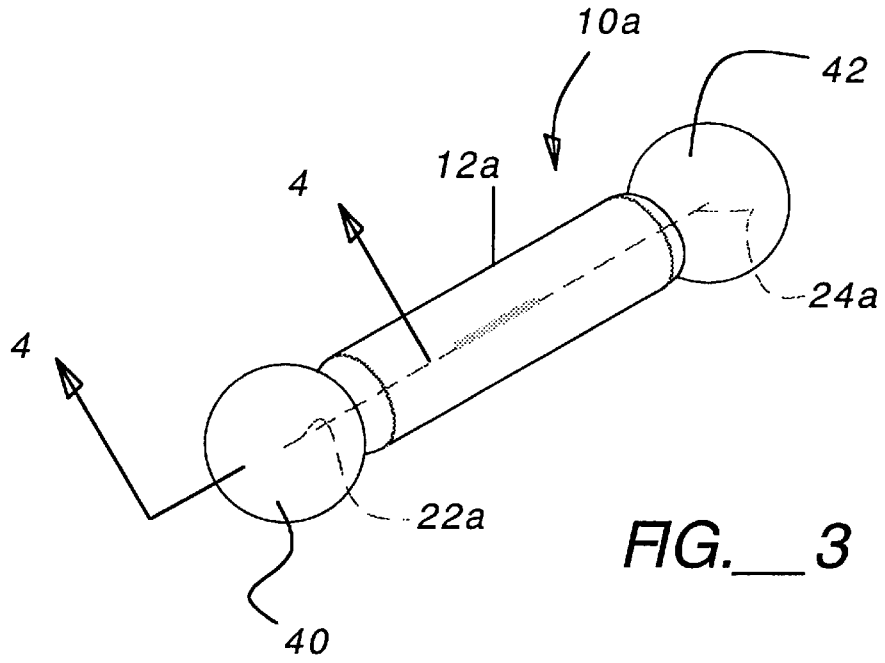
FIG.__3
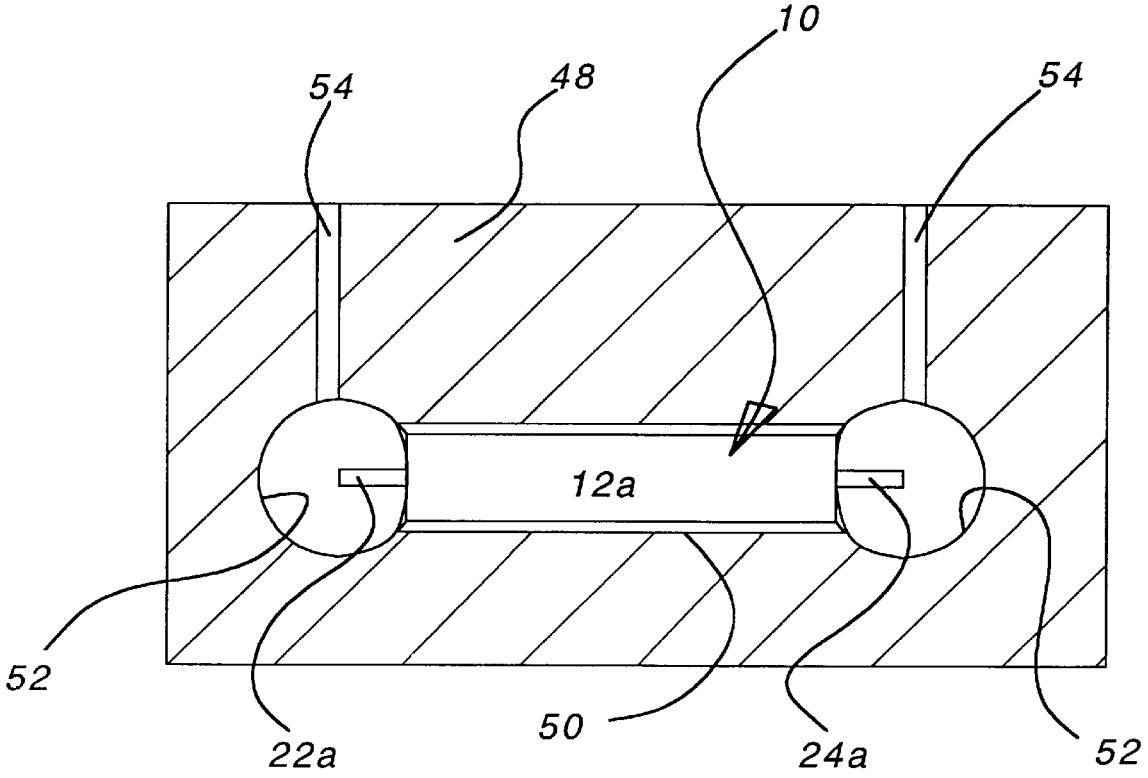
FIG.__5

SURFACE MOUNT ASSEMBLY FOR INCANDESCENT LAMPS AND OTHER ELECTRICAL COMPONENTS

BRIEF DESCRIPTION OF THE INVENTION

This invention relates in general to a surface mount assembly for mounting a light source or other electrical component to a surface and, more particularly, to a miniature lamp which is mountable to printed circuit boards, lighting panels and other surfaces.

BACKGROUND OF THE INVENTION

Miniature incandescent lamps are used as a light source for large area lighting panels which are used in a variety of different products as for example watches, clocks, pagers, hand-held computers, electronic organizers and the like. The lamps may also be used independently to illuminate condition indicators such as on-off indicators, the exposed surfaces of an LCD or lighting panel, and the like. The lamp is typically mounted to an associated circuit which includes the power source for illuminating the lamp. Although the axial ends of the leads projecting from the lamp envelope may be used to mount the lamp to a circuit board, this requires manipulation of the fragile leads to bring the leads into contact with the associated circuit and does not allow for automatic assembly. Some lamps include metal end caps on either end to facilitate mounting of the lamp to the circuit board and allow the use of automated equipment. The leads are affixed to the metal caps which are then positioned in contact with the associated circuit. U.S. Pat. No. 4,952,838 discloses a surface mount miniature incandescent lamp which includes open-ended caps filled with a resilient material.

The miniature lamp assemblies are typically mounted to a circuit board by soldering the leads, metal end caps or the like to solder bond pads on the surface of the board to connect the lamps to the associated circuitry. Although lamps having metal end caps are easier to install, the end caps increase the number of components employed in the lamp assembly. A miniature incandescent lamp offering the stability and ease of handling of the metal end caps with a minimum number of components is desirable. A surface mount system which facilitates the installation of the lamp on the circuit board is desirable. Other electrical components, such as diodes, capacitors, resistors and the like, are often mounted to a circuit board by soldering leads to solder bond pads or the like on the circuit board. A surface mount system which may be conveniently and efficiently used to mount other electrical components to a circuit board is also desirable.

OBJECTS AND SUMMARY OF THE INVENTION

It is an object of the present invention to provide an improved surface mount assembly for mounting a component to a circuit board.

It is a further object of the invention to provide an improved miniature incandescent lamp.

It is another object of the present invention to provide a miniature lamp assembly in which the leads form electrically conductive mounting members for directly mounting the lamp assembly to a circuit board.

It is yet another object of the present invention to provide a miniature lamp assembly which may be efficiently and safely installed using automated equipment.

A more general object of the present invention is to provide a durable, versatile and reliable surface mount assembly for mounting miniature lamps and other electrical components to a surface which may be economically and efficiently manufactured using automated equipment.

In summary, the invention provides a surface mount miniature lamp assembly. The miniature lamp assembly includes an elongated sealed envelope. A filament is positioned in the envelope and attached to leads which extend through the spaced ends of the sealed envelope. A metal material is applied to the leads, and the leads and metal are configured to form mounting members at opposite ends of the envelope which may be used to directly mount the sealed envelope to a circuit board. In one modification of the invention, the leads are wrapped around the ends of the sealed envelope in coils. A metal material, such as solder, is applied to secure the leads in the coiled configuration. In another embodiment, the leads extend axially from the ends of the envelope and are embedded in solid metal contacts.

Additional objects and features of the invention will be more readily apparent from the following detailed description and appended claims when taken in conjunction with the drawings.

BRIEF DESCRIPTION OF THE DRAWINGS

The foregoing and other objects of the invention will be more readily apparent from the following detailed description and appended claims when taken in conjunction with the drawings of which:

FIG. 1 is an enlarged perspective view of a miniature lamp assembly in accordance with the present invention.

FIG. 2 is an enlarged cross sectional view taken substantially along line 2—2 of FIG. 1.

FIG. 3 is an enlarged perspective view of a miniature lamp assembly in accordance with another embodiment of the present invention.

FIG. 4 is an enlarged cross sectional view taken substantially along line 4—4 of FIG. 3.

FIG. 5 is a schematic view of a mold used in the assembly of the lamp assembly of FIG. 3.

DETAILED DESCRIPTION OF THE INVENTION

Reference will now be made in detail to the preferred embodiment of the invention, which is illustrated in the accompanying figures. Turning now to the drawings, wherein like components are designated by like reference numerals throughout the various figures, attention is directed to FIGS. 1 and 2.

FIG. 1 shows a miniature incandescent lamp 10 which is particularly suitable for illuminating lighting panels and other electrical components as well as watches, clocks, pagers, hand-held computers, organizers, condition indicators, LCDs, and the like. To better appreciate the size of the assembly, the miniature lamp assembly of this embodiment has an overall size on the order of 0.245 inches (6.2 mm) long and 0.058 inches (1.5 mm) in diameter. The miniature lamp 10 generally includes a cylindrical envelope 12 having spaced ends 14 and 16 which are each sealed with a bead 18 (FIG. 2). The envelope 12 is evacuated, and a filament 20 is enclosed in the sealed envelope 12. Leads 22 and 24 extend outwardly from the filament through the ends 14 and 16 of the envelope. In this embodiment, the leads 22 and 24 extend through and are supported by the beads 18. However, it is to be understood that the construction of the sealed envelope 12 is not to be limited to the configuration shown in FIGS. 1 and 2, where the ends of the envelope are sealed by beads 18. Instead, the sealed envelope 12 may be formed using other means as is known in the art.

Leads 22 and 24 are formed of a pliable, electrically conductive metal such as dumet wire with copper cladding and tin plating. In this embodiment, the leads 22 and 24 are extensions of the filament 20 and are coupled to the filament for assembly in the lamp 10. The sections of the leads 22 and 24 projecting from the ends 14 and 16 of the sealed envelope 12 are bent into a coiled configuration, generally designated 26 and 28, where the leads are wrapped around the exterior of the envelope 12. Preferably, the leads are of sufficient length such that each coil includes several turns of the leads. In the embodiment shown in FIG. 1, there are six turns of lead in each coil, although it is to be understood that this number may be increased or decreased if desired. A metal material, generally designated 30, is applied to each coil to hold the leads 22 and 24 in the coiled configuration during shipment, handling and mounting of the lamp 10. Examples of suitable metal materials include a 96/4 tin silver compound.

Miniature lamps are commonly employed by mounting the lamp to a circuit board with the leads coupling the filament to the associated circuitry. As is shown in FIG. 2, miniature lamp 10 of this invention is mounted to a circuit board 32 by soldering the lead coils 26 and 28 to a solder pad 34 or another contact point as is known in the art. Thus, in accordance with this invention the lead coils 26 and 28 form electrically-conductive mounting members used to mount the lamp 10 to the board 32. To facilitate attachment of the lamp 10 to the circuit board 32, each coil 26 and 28 preferably includes at least 5 turns of lead. With the lamp 10 of the illustrated embodiment, the coils 26 and 28 each have a length of about 0.04 to 0.06 inches, for example 0.05 inches, leaving about 0.125 inches of the lamp exposed for illumination. Providing the coils 26 and 28 with a length in the range of 0.05 inches provides some flexibility in the accurate placement of the lamp 10 on the board 32 while maximizing the amount of light which is emitted from the lamp 10.

In a preferred form of the invention, the metal material 30 has a higher melting temperature than the solder which is used to attach the lamp assembly 10 to the circuit board 32. As a result, the metal material 30 remains in a substantially solid state during application of the lamp 10 to the circuit board 32, ensuring the leads 22 and 24 are retained in the coiled configurations 26 and 28. However, it is to be understood that in other modifications it may be desirable to utilize a metal material 30 having a melting point which equal to or less than the melting point of the solder attaching the lamp to the circuit board.

Another embodiment of a lamp assembly 10*a* is shown in FIGS. 3–5. As is shown particularly in FIGS. 3 and 4, with this embodiment the leads 22*a* and 24*a* extend axially from the ends 14*a* and 16*a* of the cylindrical envelope 12*a*. In the illustrated embodiment, the length of the leads 22*a* and 22*a* projecting from the envelope is preferably in the range of 0.02 to 0.04 inches, for example 0.035 inches as shown in FIGS. 3 and 4. The leads 22*a* and 22*a* are each embedded in a solid metal body 40, 42 which provide electrically conductive mounting members. In the illustrated embodiment, the metal bodies 40 and 42 are in the form of a spherical bead, although the bodies 40 and 42 may also have other shapes such as a donut, square or wheel. One or both of the bodies 40 and 42 may be provided with a flattened side (not shown) if desired to facilitate mounting of the lamp assembly 10*a* to the circuit board 32*a*.

In most applications of this invention, metal bodies 40 and 42 preferably have a diameter greater than the diameter of the envelope 12*a* such that when the lamp 10 is mounted to the circuit board 32*a*, the bodies 40 and 42 insure contact to the solder pads 34*a* and the envelope 12*a* is supported above the surface of the board 30 to allow some degree of cooling to the underside of the lamp envelope 12.

However, in other applications the circuit board 32*a* may be constructed such that metal bodies 40 and 42 having a diameter less than or equal to that of the cylindrical envelope 12*a* are preferred. In this instance the circuit board may be fitted with a depression or slot to accept the lamp envelope.

Suitable materials for the metal body include a 96/4 tin silver material or a 10/90 tin lead material. As with the previous embodiment, bodies 40 and 42 are preferably formed of a material which has a higher melting temperature than that of the solder used to mount the lamp assembly 10*a* to the circuit board 32*a*. Thus, the metal bodies 40 and 42 will remain substantially intact in solid form during and following mounting of the lamp 10 to the circuit board 32*a*.

The lamp assembly 10*a* may be constructed by first forming the cylindrical envelope 12*a* with the leads 22*a* and 22*a* projecting therefrom as is known in the art. The envelope 12*a* is then positioned in a suitable mold 48 having a circumferential shelf 50 for supporting the envelope 12*a* and a pair of cavities 52 positioned to receive the leads 22 and 24. The material used to form the bodies 40, 42 is injected through ports 54 to fill the cavities 52 and then the assembly is allowed to cool to form the metal bodies 40 and 42.

As is apparent from the foregoing description, the lamp assembly 10 of this invention does not include the end caps and resilient material between the end caps and the fragile lamp envelope which are used in the art to facilitate the automatic installation of the lamp assembly. Reducing the number of components in the lamp assembly 10 is of particular advantage in that it facilitates the manufacturing process and reduces the total cost of the assembly. With the embodiment shown in FIGS. 1 and 2, the leads 22 and 24 are deformed into coiled configurations around the ends of the lamp similar in appearance to the end caps used in the prior art. However, unlike end caps the coiled configurations 26 and 28 do not require the incorporation of a resilient, cushion material between the leads 22 and 24 and the envelope 12. Moreover, instead of aligning and carefully inserting the ends of the envelope into separate metal caps as is known in the art, with the present invention the leads 22 and 24 are easily and conveniently wrapped around the envelope ends. With the embodiment shown in FIGS. 3 and 4, the leads 22*a* and 24*b* are each molded in a metal body 40, 42. The lamp assembly 10*a* may be efficiently constructed by placing the partially assembled lamp 10*a* into a mold to form the metal bodies 40, 42. The coils 26 and 28 and the metal bodies 40 and 42 facilitate the automatic installation of the lamp assembly 10*a*.

The surface mount assembly of this invention is described in relation to the mounting of a miniature incandescent lamp to a circuit board, lighting panel and the like. However, it is to be understood that this invention may also be used to mount other electrical components such as diodes, capacitors, resistors and the like, to a circuit board, where such electrical component is mounted to a circuit board by soldering leads projecting from the component to solder bond pads or the like on the circuit board.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A miniature lamp assembly comprising:

an elongated sealed envelope having spaced first and second ends;

a filament positioned in said sealed envelope;

first and second leads coupled to said filament and each extending from one of said first and second ends of said sealed envelope;

a metal material melted onto said first and second leads, and cooled to solidify the metal material;

said leads and said solidified metal material being configured to form a pair of electrically conductive mounting members positioned at said ends of said envelope for mounting said envelope to a circuit board.

2. The miniature lamp assembly of claim 1 in which said leads are coiled around said ends of said envelope and said metal material secures said leads in the coiled configuration to form said mounting members.

3. The miniature lamp assembly of claim 2 in which said coils each include several turns of said first and second leads.

4. The miniature lamp assembly of claim 1 in which said leads extend axially from said ends of said envelope and are embedded in a bead of said metal material to form said mounting members.

5. The miniature lamp assembly of claim 4 in which said bead of said metal material is spherically shaped.

6. The miniature lamp assembly of claim 1 in which said metal material has a melting temperature higher than the melting temperature of the solder mounting pads on a circuit board such that said mounting members remain substantially intact when said envelope is mounted to a circuit board.

7. In combination, the miniature lamp assembly of claim 1 and a circuit board, said mounting members defined by said leads and said metal material being directly mounted to said circuit board.

8. A method of assembling a miniature incandescent lamp comprising the steps of:

forming an elongate sealed cylindrical body having spaced ends with a filament in said cylindrical body with first and second leads extending through said ends of said body, melting a metal material onto said leads, and configuring said leads and/or metal material to form a pair of electrically conductive mounting members positioned at the ends of the elongated sealed cylindrical body for mounting said sealed cylindrical body onto a printed circuit, and allowing the metal material to cool and solidify into said configuration.

9. The method of claim 8 in which said leads are wrapped around said body to form a pair of coils each having a plurality of turns prior to melting the metal material onto said leads.

10. The method of claim 8 in which the metal material is molded around each of said leads.

* * * * *